US009889480B2

(12) United States Patent
Nelson et al.

(10) Patent No.: US 9,889,480 B2
(45) Date of Patent: Feb. 13, 2018

(54) FLATNESS OF A ROLLED STRIP

(71) Applicant: NOVELIS INC., Atlanta, GA (US)

(72) Inventors: Paul David Nelson, North Bloomfield, OH (US); David Anthony Gaensbauer, Atlanta, GA (US); Andrew James Hobbis, Kennesaw, GA (US)

(73) Assignee: Novelis Inc., Atlanta, GA (US)

( * ) Notice: Subject to any disclaimer, the term of this patent is extended or adjusted under 35 U.S.C. 154(b) by 0 days.

(21) Appl. No.: 14/197,718

(22) Filed: Mar. 5, 2014

(65) Prior Publication Data

US 2014/0250963 A1 Sep. 11, 2014

Related U.S. Application Data

(60) Provisional application No. 61/776,241, filed on Mar. 11, 2013.

(51) Int. Cl.
*B21B 27/10* (2006.01)
*B21B 37/44* (2006.01)
(Continued)

(52) U.S. Cl.
CPC ..... *B21B 27/10* (2013.01); *B21B 37/44* (2013.01); *B21B 38/02* (2013.01);
(Continued)

(58) Field of Classification Search
CPC ..... B21B 2001/383; B21B 2015/0071; B21B 27/10; B21B 2027/103; B21B 37/24;
(Continued)

(56) References Cited

U.S. PATENT DOCUMENTS 4,270,959 A 6/1981 Matsumoto et al.
4,440,584 A * 4/1984 Takeshige ..... C21D 9/573 148/503
(Continued)

FOREIGN PATENT DOCUMENTS

CN 1805803 A 7/2006
CN 100404154 C 7/2008
(Continued)

OTHER PUBLICATIONS

International Patent Application No. PCT/US2014/020633, International Search Report and Written Opinion dated Aug. 20, 2014, 12 pages.
(Continued)

*Primary Examiner* — A. Dexter Tugbang
*Assistant Examiner* — Joshua D Anderson
(74) *Attorney, Agent, or Firm* — Kilpatrick Townsend & Stockton LLP

(57) ABSTRACT

Systems and methods for improving the flatness of a rolled sheet or strip by the application of differential cooling. A cooling agent can be selectively applied along the width of the strip. More cooling can be applied to the edges of the strip, where tension is greatest, to increase tension at the edges. The strip can be allowed to lengthen at these edges, which can improve flatness. In some embodiments, a closed loop flatness control system is used to measure the flatness of a strip and automatically adjust the differential cooling based on the measurement.

16 Claims, 6 Drawing Sheets

(51) Int. Cl.
*B21B 38/02* (2006.01)
*B21B 45/02* (2006.01)
*B21B 15/00* (2006.01)

(52) U.S. Cl.
CPC ..... *B21B 45/0209* (2013.01); *B21B 45/0218* (2013.01); *B21B 2015/0071* (2013.01); *B21B 2027/103* (2013.01); *B21B 2045/0212* (2013.01)

(58) Field of Classification Search
CPC ..... B21B 37/28; B21B 37/32; B21B 37/44; B21B 37/74; B21B 37/76; B21B 38/02; B21B 45/0203; B21B 45/0209; B21B 45/0212; B21B 45/0215; B21B 45/0218; B21B 45/0233; B21B 45/0239; B21B 45/0251; B21B 45/0245; B21B 2261/21; B21B 2263/04; B21B 2263/06; B21B 2263/08
USPC .... 72/9.1, 9.3, 11.7, 11.9, 12.7, 29.1, 31.07, 72/41–46, 161, 199–202, 342.2, 342.5, 72/342.6, 342.94
See application file for complete search history.

(56) References Cited

U.S. PATENT DOCUMENTS 4,467,629 A * 8/1984 Schimion ..... B21B 37/32 72/11.7
4,596,615 A * 6/1986 Matsuzaki ..... B21B 37/44 148/503
4,610,735 A 9/1986 Dubost
5,701,775 A * 12/1997 Sivilotti ..... B21B 45/0218 72/201
5,799,523 A 9/1998 Seidel et al.
6,128,937 A 10/2000 Seidel
6,615,633 B1 9/2003 Akashi et al.
7,434,435 B2 * 10/2008 Richter ..... B21B 37/28 72/201
7,963,136 B2 6/2011 Flick et al.
2007/0193322 A1 8/2007 Beck et al.
2009/0084153 A1 * 4/2009 Berghs ..... B21B 37/32 72/201
2010/0132426 A1 * 6/2010 Baumgartel ..... B21B 37/44 72/342.2
2011/0208345 A1 * 8/2011 Soderlund ..... B21B 37/44 700/153

FOREIGN PATENT DOCUMENTS

CN 101678419 A 3/2010
CN 101778679 A 7/2010
CN 101842171 A 9/2010
EP 1634657 A1 3/2006
JP 60166117 A 8/1985
JP 60166177 A 8/1985
JP 60187419 A 9/1985
JP 60221527 A 11/1985
JP 61193717 A 8/1986
JP 11057839 A 3/1999
JP H1157839 A 3/1999
JP 2002045908 A 2/2002
WO 2009024644 A1 2/2009

OTHER PUBLICATIONS

Korean Patent Application No. 10-2015-7028526, First Office Action dated Jul. 18, 2016, 10 pages.
Chinese Patent Application No. 201480008002.3, First Office Action dated May 30, 2016, 30 pages.
European Patent Application No. 14 721 025.6, Office Action dated Sep. 16, 2016, 6 pages.
Chinese Patent Application No. 201480008002.3, Office Action dated Jan. 22, 2017, 25 pages.
Korean Patent Application No. 10-2015-7028526, Notice of Final Rejection dated Feb. 21, 2017, 7 pages.
Canadian Patent Application No. 2,900,559, Office Action dated Oct. 12, 2016, 3 pages.
Chinese Patent Application No. 201480008002.3, Office Action dated Aug. 3, 2017, 5 pages.

* cited by examiner

FLATNESS OF A ROLLED STRIP

CROSS REFERENCE TO RELATED APPLICATIONS

The present application claims the benefit of U.S. Provisional Patent Application Ser. No. 61/776,241 filed Mar. 11, 2013, which is hereby incorporated by reference in its entirety.

TECHNICAL FIELD

The present disclosure relates to systems and methods for improving the flatness of a metal strip.

BACKGROUND

Hot and cold rolling are metal forming processes in which stock sheets or strips are passed through a pair of rolls to reduce the thickness of the stock sheet or strip. In some cases, the rolled strips are processed or otherwise treated after rolling. For example, rolled strips may pass through a coating line to apply a coating of polymeric materials or other suitable coating to the rolled strips. After the coating is applied, the coated strip may be cured in an oven. In many cases, rolled strips emerge from the oven with center waves or other distortion along the strip that reduce the overall flatness of the strip. It is thus desirable to improve the flatness of the metal strip.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

The present disclosure recites methods and systems for improving the flatness of a metal strip, including applying differential cooling across the width of a hot strip to improve the flatness of the strip. In some embodiments, a feedback control loop can be implemented including a flatness measurement device and a control system that controls the differential cooling. If used, the control system can make automatic, dynamic adjustments based on the flatness measurement of the differentially cooled strip.

BRIEF DESCRIPTION OF THE DRAWINGS

The specification makes reference to the following appended figures, in which use of like reference numerals in different figures is intended to illustrate like or analogous components.

DETAILED DESCRIPTION

Disclosed herein are systems and processes for improving the flatness of a piece of rolled metal, hereinafter referred to as a "rolled strip" or a "strip." In some embodiments, a flatness measurement device is used to measure the flatness of a rolled strip. A control system can receive the flatness measurements and control a cooling unit that differentially cools the metal strip to create a desired non-homogenous temperature gradient across the width of the metal strip. The temperature gradient generates differential tensions in the strip, which are imparted while the metal strip is sufficiently hot and can improve the flatness of the metal strip.

Figure 1:
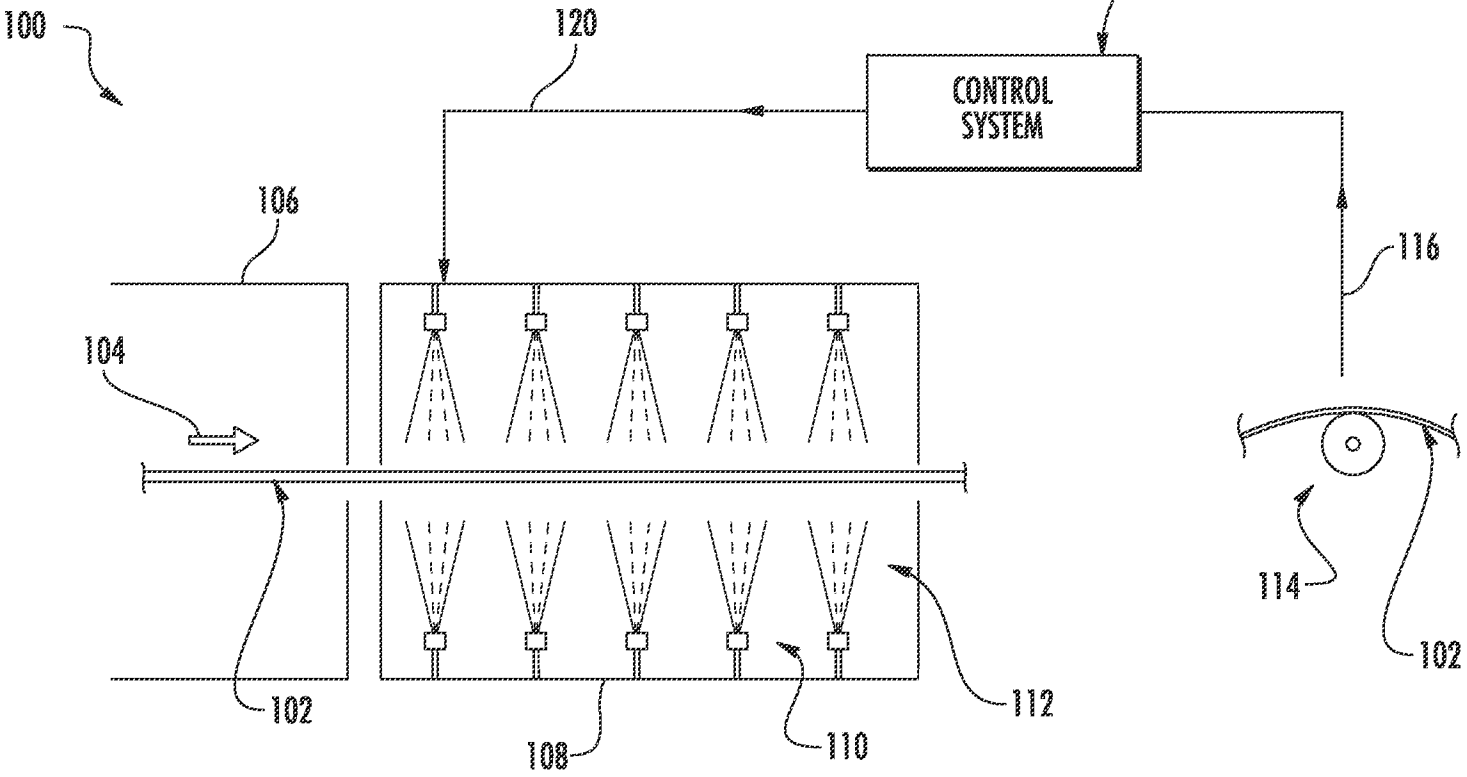
FIG. 1 is a schematic representation of a system for improving the flatness of rolled strips.

FIG. 1 is a schematic representation of a system 100 for improving the flatness of rolled strips according to one embodiment. Metal can be rolled into a strip 102. The strip 102 can optionally be coated. As shown in FIG. 1, the strip 102, moving in a direction 104, passes through an oven 106. After passing through the oven 106, the strip 102 will be hot. The strip 102 then passes through a cooling unit 108. In the embodiment illustrated in FIG. 1, cooling unit 108 includes a plurality of nozzles 110 that distribute any suitable cooling agent 112 (also referred to as a cooling medium) onto the strip 102. After passing through the cooling unit 108, the strip 102 passes through a flatness measuring device 114. The flatness measuring device 114 determines the flatness of the strip 102 and provides a flatness signal 116 to a control system 118. The control system 118 then determines the desired cooling profile and provides a cooling signal 120 to the cooling unit 108. Based on the cooling signal 120, the cooling unit 108 can control, and adjust if needed, the application of cooling agent 112, as described in further detail below.

Figure 2:
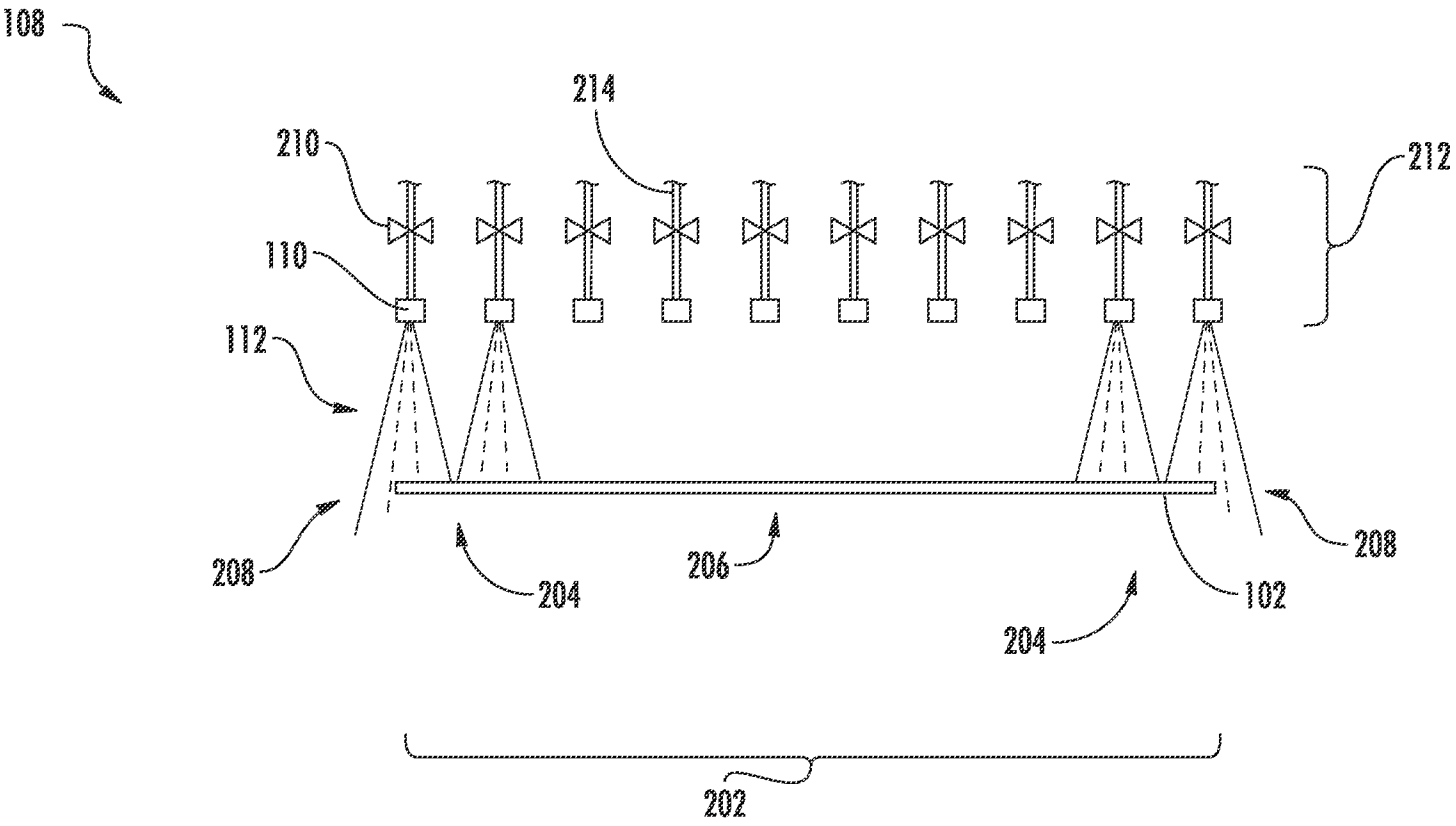
FIG. 2 is a schematic representation of a portion of a cooling unit.

FIG. 2 is a schematic representation of a portion of a cooling unit 108. The cooling unit 108 is configured to provide differential cooling across the width 202 of the strip 102 to reduce center waves or other distortion of the strip 102. The cooling unit 108 can be part of the cooling section of a continuous process line, although the differential cooling may be applied at any other suitable point during the metalworking process for rolled metals. In some embodiments, the cooling unit 108 is positioned at a point in the process line so that differential cooling is applied as the strip 102 exits the oven 106 of the coating line, although the cooling unit 108 can be otherwise positioned so differential cooling is applied to the strip 102 at other points in the process line.

As mentioned above, cooling unit 108 can distribute a cooling agent 112 to the strip 102. The cooling agent 112 can be distributed from above, below, or to the sides of the strip 102, or any combination thereof. In some embodiments, the cooling agent 112 is air, gas, water, oil, or any other cooling agent capable of sufficiently removing heat from the strip 102 to generate the desired differential cooling. The amount and application of cooling to particular locations along the width of the strip 102 can be adjusted based on the desired flatness.

Differential cooling can be achieved by cooling selected portions 204 of strip 102 along the width 202 of strip 102. In some embodiments, the selected portions 204 are portions where the strip tension is highest. Strip tension can be highest at the edges 208 of the strip 102. The more localized the stress, the less differential cooling may be required to achieve the desired improved flatness. In some cases, a relatively small amount of cooling (for example, but not limited to, cooling at or around 250° Celsius) can be applied to the edges 208 of the strip 102, which can remove or reduce significant center buckles and/or distortion from the strip 102. Portions along the width 202 of the strip 102 that receive less cooling than the selected portions 204 are referred to as unselected portions 206. Unselected portions 206 can be portions where the strip tension is lower. Differential cooling includes any difference in temperature applied across the width 202 of the strip 102. In some embodiments, a selected portion 204 (e.g., an edge 208) along the width 202 of the strip 102 can be subjected to cooling while an unselected portion 206 (e.g., the middle of the strip 102) along the width 202 of the strip 102 is not subjected to any cooling. In other embodiments, a selected portion 204 (e.g., an edge 208) along the width 202 of the strip 102 can be subjected to greater cooling than the cooling provided to the unselected portion 206 (e.g., the middle of the strip 102) along the width 202 of the strip 102.

Application of differential (also referred to as non-uniform, preferential, or selective) cooling to selected portion 204 of the width 202 of a strip 102 can cause the selected portions 204 to thermally contract, increasing the tension along the selected portions 204. Differential cooling can cause a temporary temperature gradient along the strip 102 where the selected portions 204 of the width 202 of the strip 102 (e.g., the edges 208) are cooler than the unselected portion(s) 206 (e.g., the middle).

In an embodiment where cooling is applied to the edges 208 of the strip 102 to generate the temperature gradient, the tension at the edges 208 of the strip 102 can be temporarily increased, compared to the warmer, unselected portion 206 (e.g., middle) of the strip 102. Because the temperature along the width 202 of the strip 102 is not uniform, differential tension exists along the width 202 of the strip 102. If this imposed tension distribution is not equalized soon after being applied (e.g., by intervening support rolls, or otherwise), and the strip 102 is sufficiently hot to yield slightly under the differential tension, the differential temperature imparted by the differential cooling can cause the strip 102 to lengthen slightly along the colder portion of the width 202 (e.g., the selected portions 204) of the strip 102. Yield, as used herein, can be considered a permanent strain or elongation of the strip 102, which partially relieves the applied stress (e.g., from the imposed tension distribution). The stress required to cause permanent strain decreases as the strip 102 temperature increases. As used herein with reference to strip 102, yield includes permanent strain at conventionally accepted yield stress levels, as well as at stress levels below the conventionally accepted yield stress levels, such as the permanent strain that can occur from rapid creep. Therefore, for a strip 102 to yield, as the term is used herein, it is not necessary to induce differential tension that provides stress levels at or above the conventionally accepted yield stress of the strip 102.

Regardless of whether or not the actual temperature gradient imposed on the strip 102 is known, the temperature gradient is based on the differential cooling, which can be based on various factors, such as models, flatness measurements, or other, as disclosed herein.

Differential cooling of the edges 208 of a strip 102 causes a local concentration of tensile stress sufficient to put the strip 102 into yield and stretch the edges 208, correcting any center waves or distortion present in the strip 102. In this way, the flatness of the strip 102 can be adjusted and/or improved using differential cooling. When active differential cooling of the strip 102 is discontinued, the temperature profile of the strip 102 across its width 202 will eventually equalize, but any changes due to yield will remain, and therefore the improved flatness will be maintained.

Cooling agent 112 can be delivered by cooling unit 108 in any suitable way. In one embodiment, as shown in FIGS. 1-2, cooling agent 112 is delivered through nozzles 110 of cooling unit 108. In one embodiment, such nozzles 110 are arranged in an array 212 of discrete nozzles 110. Referring to FIG. 2, cooling agent 112 can be delivered, through supply lines 214, to the nozzles 110. A valve 210 associated with each nozzle 110 moves between a closed position, in which cooling agent 112 is blocked, and an open position, in which cooling agent 112 is allowed to pass. In such embodiments, valves 210 can be controlled to determine which nozzles 110 distribute cooling agent 112 and which nozzles 110 do not. Additionally, partial closing of some valves 210 can enable some nozzles 110 to distribute less cooling agent 112 than other nearby nozzles 110 with fully opened valves 210. Valves 210 can be manually adjustable or automatically adjustable. In some embodiments, valves 210 are dynamically controlled by a control system 118.

Figure 3:
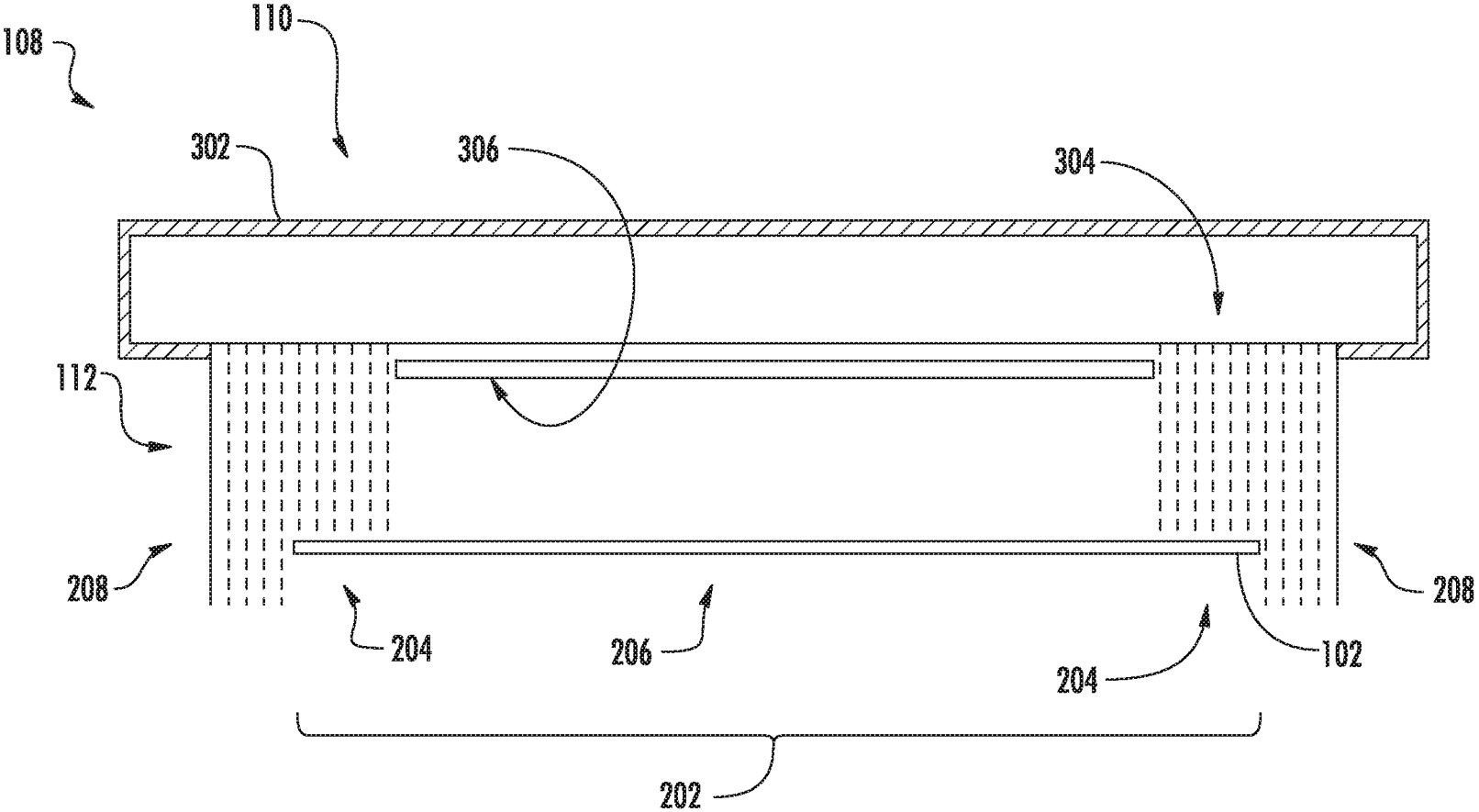
FIG. 3 is a schematic representation of a nozzle having a continuous slot.

FIG. 3 is a schematic representation of a nozzle 110 that is a continuous slot nozzle 302 having a continuous slot 304. Instead of arrays 212 of discrete nozzles 110 as shown in FIGS. 1-2, continuous slot nozzle 302 of FIG. 3 includes at least one continuous slot 304. In other embodiments, other suitable structure for distributing cooling agent 112 is utilized instead of at least one continuous slot 304. As shown in FIG. 3, continuous slot nozzle 302 includes a sleeve 306 that partially blocks cooling agent 112 from being applied to the strip 102. In this way, cooling agent 112 can be directed to selected portions 204 (e.g., the edges 208) of the strip 102 to cool the strip 102 at the selected portion 204 (e.g., those edges 208). As also described above, application of cooling agent 112 can be controlled across the width 202 of the strip 102 so that the cooling is uneven transversely across the width 202 of the strip 102. Application of cooling agent 112 can be entirely or partially suppressed across unselected portions 206 of the strip.

Figure 4:
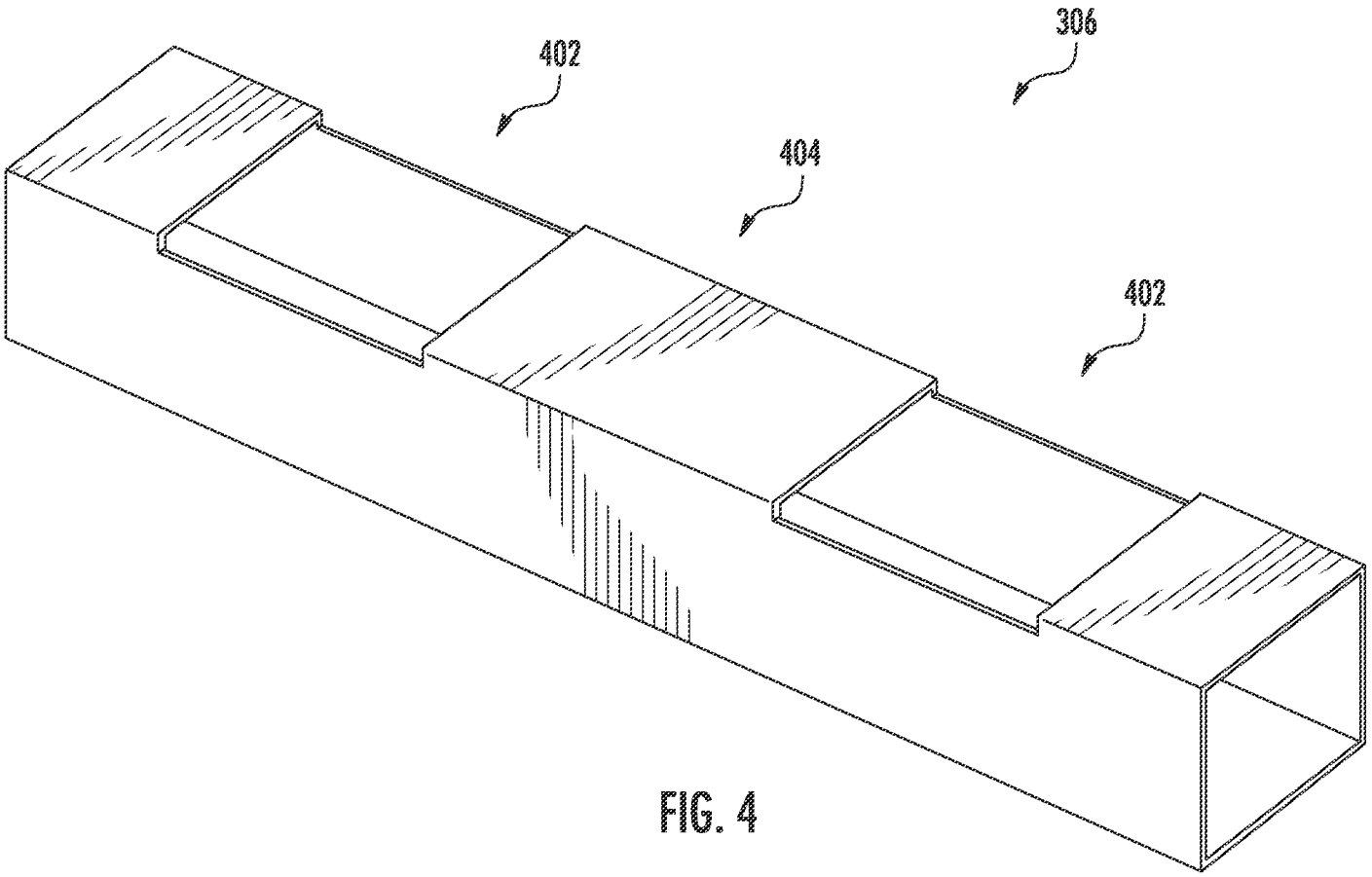
FIG. 4 is an isometric view of a sleeve.

FIG. 4 is an isometric view of a sleeve 306 (sometimes referred to as a cover) according to one embodiment. Sleeve 306 includes one or more openings 402 through which cooling agent 112 can be allowed to flow. The openings 402 can be of various shapes and sizes. The portion of sleeve 306 between the openings 402 is an occlusion portion 404, which blocks cooling agent 112 from being applied to the strip 102.

Figure 5:
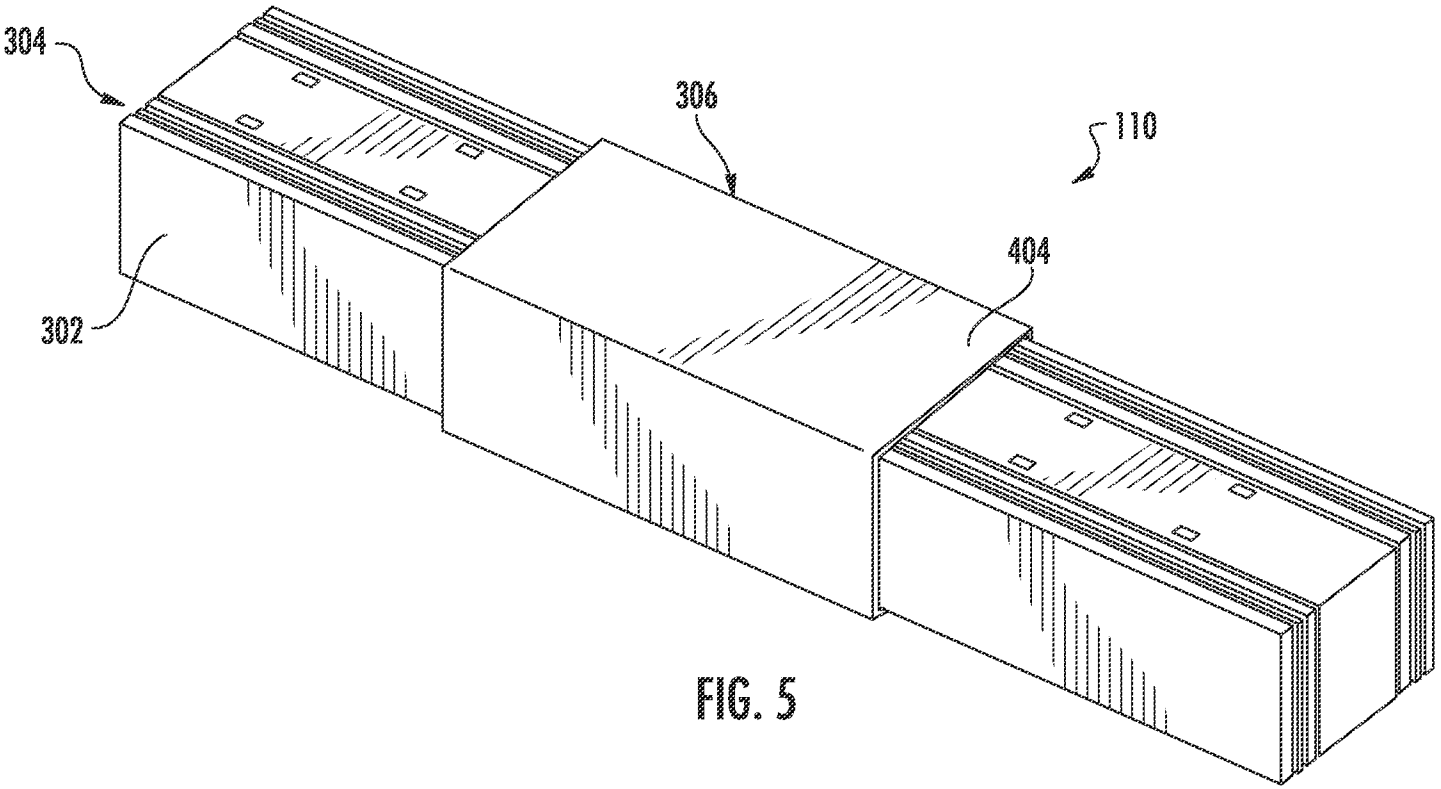
FIG. 5 is an isometric view of a continuous slot nozzle having a sleeve.

FIG. 5 is an isometric view of a continuous slot nozzle 302 with a sleeve 306 according to another embodiment. Sleeve 306 includes at least one occlusion portion 404. As described above, continuous slot 304 is configured to apply cooling agent 112 to strip 102. The sleeve 306 depicted in FIG. 5 includes one occlusion portion 404, which occludes at least some of the width of the continuous slot 304, thereby blocking cooling agent 112 from being applied to the strip 102 where the sleeve 306 occludes the continuous slot 304. The occlusion portion 404 of the sleeve approximately corresponds to the unselected portion 206 of the strip 102.

In some embodiments, the occlusion portion(s) 404 can be designed to partially limit, as opposed to completely block, the amount of cooling agent 112 delivered to the unselected portion 206 of the strip 102. The occlusion portion(s) 404 can be designed to at least partially limit delivery of cooling agent 112 in various ways, including, for example, having holes or being made of a mesh material.

In some embodiments, the sleeve 306 can be movable and/or adjustable to adjust the size and/or position of the occlusion portion 404 with respect to the continuous slot 304. The sleeve 306 can incorporate two overlapping sleeves 306 that slidably move with respect to one another, wherein each of their occlusion portions 404 can overlap to varying extents in order to adjust the size of the actual occlusion portion 404 with respect to the continuous slot 304. The sleeve 306 can be manually adjustable or automatically adjustable. In some embodiments, the sleeve 306 may be dynamically adjusted by a control system 118. The sleeve 306 can be adjusted depending on the desired distribution path of the cooling agent 112 and the desired flatness of the strip 102. In some embodiments, each sleeve 306 may be adjusted differently along the strip 102 (e.g., over each edge 208 of the strip 102) to provide independent control so that the strip 102 can be asymmetrically cooled relative to a midpoint of the width 202 of the strip 102.

Figure 6:
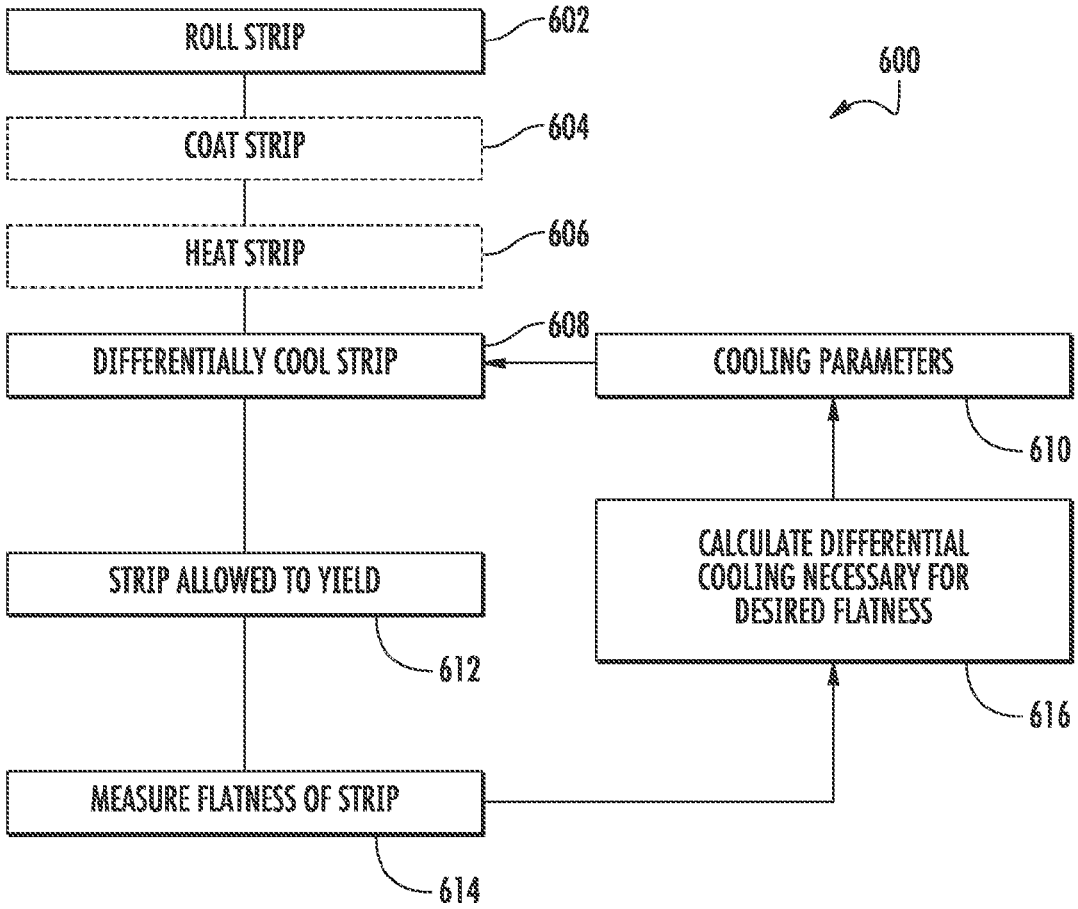
FIG. 6 is a flow chart of a portion of a metalworking process including a feedback control loop for calculating and applying differential cooling.

In some embodiments, the differential cooling described above can be applied and adjusted using information obtained from a feedback control loop. FIG. 6 is a flow chart of a portion of a metalworking process 600 including an exemplary feedback control loop for calculating and applying differential cooling. With reference to FIG. 6, a metal strip 102 is rolled at block 602. The strip 102 is optionally coated at block 604. The strip 102 is optionally heated at block 606. Differential cooling is applied to the strip 102 by a cooling unit 108 at block 608, according to cooling parameters at block 610. Cooling parameters can be stored in the control system 118. After the strip 102 is differentially cooled at block 608, the strip 102 is allowed to yield at block 612. At block 612, the strip 102 can be kept away from portions of the metalworking process (e.g., intervening support rolls, or otherwise) that can equalize the temperature gradient across the width 202 of the strip 102 or mechanically equalize the imposed tension distribution across the width 202 of the strip 102 (e.g., by the strip 102 wrapping around an intervening roller) before the strip 102 has been allowed to yield. The flatness of the strip 102 is measured at block 614. Results from the flatness measurement of block 614 are used to calculate the differential cooling necessary for the desired flatness at block 616. The cooling parameters are adjusted at block 610 based on the calculated differential cooling from block 616. In some embodiments, updated cooling parameters are sent to the cooling unit 108 to make adjustments to the distribution of cooling agent 112. In alternate embodiments, cooling parameters are stored in a storage device and updated as needed. In these embodiments, the cooling unit 108 accesses (e.g., routinely accesses or otherwise is prompted to access) the storage device to determine how to distribute the cooling agent 112.

As described above, the system 100 shown in FIG. 1 may optionally include a closed feedback loop control system 118 that enables automatic control and/or adjustment of the differential cooling based on measurements of the strip's 102 flatness. In some embodiments, feedback loop control system 118 proceeds as illustrated in FIG. 6. Measurement of the strip's 102 flatness can be taken upstream or downstream of the cooling unit 108. The order of blocks in FIG. 6 can be adjusted accordingly.

The flatness measuring device 114 of FIG. 1 may be a segmented stress roll (e.g., a stressometer roll produced by ABB Ltd), an optical device (e.g., a VIP optical flatness measurement device produced by Volmer America, Inc. or a non-contact laser system such as produced by Shapeline in Linköping, Sweden), or a different suitable measuring technique capable of measuring the flatness of the sheet in order to provide a flatness signal 116 to the control system 118.

In some embodiments, the flatness measuring device 114 is positioned so it is higher than the strip 102. In other embodiments, the flatness measuring device 114 is positioned at any suitable height and in any suitable location. In some embodiments, the actual flatness of the strip 102 is measured downstream of the cooling unit 108 or at another location where the strip 102 temperature is approximately uniform (e.g., the temperature profile of the strip has substantially equalized so the temperature gradient is substantially no longer present) to obtain an accurate reading of flatness.

The control system 118 can use the flatness signal 116 to determine any necessary adjustments that are to be made to the cooling unit 108 in order to achieve the desired flatness. The control system 118 can compare the measured flatness from the flatness measuring device 114 with a desired flatness that has been previously selected and/or stored in the memory of the control system 118. The control system 118 can then send a cooling signal 120 to the cooling unit 108. The cooling signal 120 can direct the cooling unit 108 to adjust the dispersion of cooling agent 112 as described herein. Adjustments can be made to the volume and/or temperature of the cooling agent 112 and/or the locations to which the cooling agent 112 will be applied relative to the strip 102 (e.g., the size and position of the selected portions 204).

In one embodiment, delivery of the cooling agent 112 is adjusted by adjusting the one or more moveable sleeves 306, as described herein. In other embodiments, the delivery of cooling agent 112 is adjusted by adjusting valves 210 in the supply lines 214 to discrete cooling nozzles 110. In this way, the flatness measurement of a strip 102 can be used to automatically and dynamically adjust and control the differential cooling to improve the flatness of the strip 102. The feedback control system enables the differential cooling of the strip 102 to serve as an adjustable actuator to adjust and correct any buckling and/or curvature of the strip 102, so its flatness reaches a desired level. The flatness then can be optimized by automatic feed-forward or feedback control, depending on the actual flatness measurement.

In some embodiments, the control system 118 can use information from a model-based approach (e.g., a coil stress model) instead of flatness measurements to determine the necessary differential cooling to be applied to the strip 102. A flatness measuring device 114 can be omitted in some embodiments. In some embodiments, using a model-based approach eliminates or reduces the need for actual measurements of the flatness of the strip 102, such that the determination of what differential cooling is to be applied could be made based on the model.

It can be desirable to differentially cool strips 102, as described herein, after rolling, at least because distortions can appear in the strip 102 after rolling, although the differential cooling described herein is not so limited. It can be desirable to differentially cool strips 102, as described herein, after the strip 102 has been coated and passed through an oven 106, at least because the coating and heating stages can induce distortions in the strip 102. However, differential cooling is not limited to use in cooling sections after the strip 102 passes through a coating line. Instead, differential cooling can be applied in any other suitable process line or at any other stage in the process. For example, differential cooling can be applied at the cooling section of a continuous annealing line, or at any other suitable line or stage of the process. In addition, the differential cooling described above can also be used to control the camber (sometimes referred to as the lateral bow) of the strip by applying differential cooling resulting in an asymmetric temperature gradient. Various embodiments can apply differential cooling, as described above, in various desired fashions along any suitable thermal line, including cold rolling mills.

It can be desirable to differentially cool strips 102, as described herein, rather than use other flattening devices in an effort to improve the flatness of the strip 102, at least because other flattening devices can add in some degree of unflatness, harm coatings and/or finishes of the strip 102, and/or can have negative effects (e.g., reduced formability of the strip 102 due to leveling) on certain mechanical properties of the strip 102. It can be desirable to differentially cool strips 102, as described herein, rather than use other methods, at least because the differential cooling described herein can produce strips 102 with increased uniformity across the width 202 of the strip 102. It can be desirable to differentially cool strips 102, as described herein, over other methods, as it can reduce the amount of leveling that may be necessary downstream.

All patents, publications and abstracts cited above are incorporated herein by reference in their entirety. Various embodiments have been described. It should be recognized that these embodiments are merely illustrative of the principles of the present disclosure. Numerous modifications and adaptations thereof will be readily apparent to those skilled in the art without departing from the spirit and scope of the present disclosure as defined in the following claims.

What is claimed is:

1. A system for improving flatness of rolled metal, comprising:

a cooling unit configured to distribute cooling agent to a strip moving in a longitudinal direction such that the cooling agent distributed by the cooling unit induces a non-homogenous temperature gradient across a width of the strip and subsequent differential tensions across the width of the strip that induces localized increased tension in high tension regions of the strip, wherein the cooling unit comprises at least one nozzle having openings positioned adjacent lateral edges of the width of the strip to distribute more of the cooling agent to the lateral edges of the strip than to a middle of the width of the strip when cooling agent is distributed through the openings of the at least one nozzle, and wherein the cooling unit is positioned a distance upstream of any additional equipment capable of equalizing tension or temperature across the width of the strip, the distance defined by a minimum distance after distribution of the cooling agent is discontinued necessary for the strip to reduce the non-homogenous temperature gradient prior to contacting the additional equipment.

2. The system of claim 1, wherein the at least one nozzle comprises a continuous slot for distributing the cooling agent and a sleeve comprising an occlusion portion positioned to block distribution of the cooling agent onto the middle of the width of the strip.

3. The system of claim 1, wherein:

the at least one nozzle comprises a plurality of nozzles for applying the cooling agent to the strip;

one or more valves fluidly connecting respective ones of the plurality of nozzles to a supply of the cooling agent, each of the one or more valves being actuatable to restrict flow of the cooling agent from the respective ones of the nozzles; and the cooling unit is operable to actuate the one or more valves of the plurality of nozzles to block distribution of the cooling agent on the middle of the width of the strip.

4. The system of claim 3, wherein:

the cooling unit is further operable to cool a first portion of the cooling agent distributable through a first set of the plurality of nozzles to a temperature below a second portion of the cooling agent distributable through a second set of the plurality of nozzles;

the first set of the plurality of nozzles is positioned to distribute the first portion of the cooling agent to the lateral edges of the width of the strip; and the second set of the plurality of nozzles is positioned to distribute the second portion of the cooling agent to the middle of the width of the strip.

5. The system of claim 1, wherein the cooling agent is air blown through the at least one nozzle.

6. The system of claim 1, additionally comprising a flatness measuring device, wherein:

the flatness measuring device outputs a flatness signal indicative of the flatness of the strip along the width of the strip; and the cooling unit is operable to cool the lateral edges of the width of the strip more than the middle of the width of the strip to induce the non-homogenous temperature gradient based on the flatness signal.

7. The system of claim 6, additionally comprising a control system, wherein:

the control system is operable to compare the flatness signal to a desired flatness and output a cooling signal to the cooling unit; and the cooling unit is coupled to the control system to cool the lateral edges of the width of the strip more than the middle of the width of the strip based on the cooling signal.

8. The system of claim 1, wherein the strip is coated.

9. A system for improving flatness in rolled metal, comprising:

a cooling unit configured to distribute cooling agent to a strip moving in a longitudinal direction;

a plurality of nozzles fluidly connected to a supply of cooling agent and positioned in the cooling unit;

a control system coupled to the cooling unit and configured to control the plurality of nozzles to distribute more cooling agent to lateral edges of the strip than a middle of the strip to induce a non-homogenous temperature gradient across a width of the strip, wherein the cooling unit is positioned a distance upstream of any additional equipment capable of equalizing tension or temperature across the width of the strip, the distance defined as a minimum distance after distribution of the cooling agent is discontinued necessary for the strip to reduce the non-homogenous temperature gradient prior to contacting the additional equipment; and a flatness measuring device positioned to measure a flatness of the strip and coupled to the control system to transmit a flatness signal to the control system;

wherein the controller controls the cooling unit to induce the non-homogenous temperature gradient as desired based on a comparison of the flatness signal and a desired flatness of the strip.

10. The system of claim 9, wherein:

the cooling agent is air;

the non-homogenous temperature gradient includes the middle of the strip having a first temperature at or above a yield temperature of the strip; and the non-homogenous temperature gradient includes the lateral edges of the strip each having a second temperature below the first temperature.

11. A system for improving flatness of rolled metal, comprising:

a cooling unit comprising a plurality of nozzles configured to distribute cooling agent to a strip moving in a longitudinal direction such that the cooling agent distributed by the cooling unit induces a non-homogenous temperature gradient across a width of the strip, wherein the cooling agent includes a first portion of the cooling agent having a temperature below a second portion of the cooling agent, wherein the plurality of nozzles includes a first set of nozzles for distributing the first portion of the cooling agent and a second set of nozzles for distributing the second portion of the cooling agent, wherein the first set of nozzles is positioned adjacent lateral edges of the width of the strip to distribute the first portion of the cooling agent to the lateral edges of the width of the strip and the second set of nozzles is positioned adjacent a middle of the width of the strip to distribute the second portion of the cooling agent to the middle of the width of the strip to induce the non-homogenous temperature gradient, and wherein the cooling unit is positioned a distance upstream of any additional equipment capable of equalizing tension or temperature across the width of the strip, the distance defined by a minimum distance after distribution of the cooling agent is discontinued necessary for the strip to reduce the non-homogenous temperature gradient prior to contacting the additional equipment.

12. The system of claim 11, further comprising:

one or more valves fluidly connected to respective ones of the plurality of nozzles, each of the one or more valves being actuatable to restrict flow of the cooling agent from the respective ones of the nozzles, wherein the cooling unit is operable to actuate the one or more valves of the plurality of nozzles to block distribution of the cooling agent on the middle of the width of the strip.

13. The system of claim 11, wherein the cooling agent is air blown through the plurality of nozzles.

14. The system of claim 11, additionally comprising a flatness measuring device, wherein:

the flatness measuring device outputs a flatness signal indicative of the flatness of the strip along the width of the strip; and the cooling unit is operable to cool the lateral edges of the width of the strip more than the middle of the width of the strip based on the flatness signal.

15. The system of claim 14, additionally comprising a control system, wherein:

the control system is operable to compare the flatness signal to a desired flatness and output a cooling signal to the cooling unit; and the cooling unit is coupled to the control system to cool the lateral edges of the width of the strip more than the middle of the width of the strip based on the cooling signal.

16. The system of claim 11, wherein the strip is coated.

* * * * *